US005282726A

United States Patent [19]

Warren

[11] Patent Number: 5,282,726

[45] Date of Patent: Feb. 1, 1994

[54] COMPRESSOR SUPERCHARGER WITH EVAPORATIVE COOLER

[75] Inventor: James R. Warren, Lakeview, N.Y.

[73] Assignee: Praxair Technology, Inc., Danbury, Conn.

[21] Appl. No.: 718,797

[22] Filed: Jun. 21, 1991

[51] Int. Cl.[5] ..... F04B 23/00

[52] U.S. Cl. ..... 417/243; 417/228; 415/116

[58] Field of Search ..... 417/243, 228; 261/117, 261/118; 60/605.1; 123/25 A; 415/116

[56] References Cited

U.S. PATENT DOCUMENTS

| | | | |
|---|---|---|---|
| 1,400,813 | 12/1921 | Graemiger | 415/116 |
| 2,280,845 | 4/1972 | Parker | 417/243 |
| 2,549,819 | 4/1951 | Kane | 261/118 |
| 2,786,626 | 3/1957 | Redcay | 230/209 |
| 3,387,770 | 6/1968 | Persson | 417/243 |
| 3,570,265 | 3/1971 | Henry et al. | 62/304 |
| 3,642,384 | 2/1972 | Huse | 417/243 |
| 3,758,081 | 9/1973 | Prudhon | 261/118 |
| 3,922,110 | 11/1975 | Huse | 417/243 |
| 3,947,146 | 3/1976 | Schuster | 415/116 |
| 4,063,855 | 12/1977 | Paul | 417/228 |
| 4,362,462 | 12/1982 | Blotenberg | 417/243 |
| 4,417,847 | 11/1983 | Kube | 415/116 |
| 4,670,221 | 6/1987 | Marnet | 261/118 |
| 4,695,224 | 9/1987 | Lown | 415/116 |
| 4,758,138 | 7/1988 | Timuska | 418/100 |
| 4,991,391 | 2/1991 | Kosinski | 60/39.182 |

FOREIGN PATENT DOCUMENTS

| | | | |
|---|---|---|---|
| 134981 | 3/1985 | European Pat. Off. . | |
| 1239888 | 5/1967 | Fed. Rep. of Germany . | |
| 3403647 | 9/1984 | Fed. Rep. of Germany . | |
| 2024672 | 8/1970 | France . | |
| 101873 | 7/1922 | Switzerland | 415/116 |

*Primary Examiner*—Richard A. Bertsch
*Assistant Examiner*—Peter Korytnyk
*Attorney, Agent, or Firm*—Peter Kent

[57] ABSTRACT

Apparatus and method for increasing the capacity of a gas compressor. The apparatus comprises a supercharger for compressing a gas flow and an evaporative cooler for cooling and ducting the supercharged gas flow to the gas compressor. The cooler comprises a section of pipe connecting the supercharger and the compressor. Mounted on the wall of the pipe are nozzles oriented upstream to atomize water into droplets of mean diameter ranging from about 4 to about 12 microns. The pipe is sized to provide a residence time of from about 0.1 to about 0.5 seconds for the droplets in the gas flow.

16 Claims, 2 Drawing Sheets

COMPRESSOR SUPERCHARGER WITH EVAPORATIVE COOLER

TECHNICAL FIELD

This invention pertains to a supercharger with an evaporative cooler for an air compressor.

BACKGROUND

Air compressors are commonly used to supply compressed air for air separation plants and other types of plants. Frequently the plant capacity is larger than that of the air compressor initially installed. Often, at some time after the initial installation, an increase in the plant production rate is desired necessitating increased air compressor capacity.

Methods used in the past to increase the air compressor capacity have been to replace the existing compressor with a new larger compressor, to install a complementary compressor in parallel with the existing compressor, or to retrofit the existing compressor with internal parts having higher flow capacity. Plant air compressors are often multistage units with intercooling and aftercooling. Sizes range from 500 HP to 15,000 HP.

Thus replacement of an existing compressor with a new compressor of higher capacity usually cannot be economically justified because of the high capital cost. Retrofit of an existing machine involves replacement of the major rotating assemblies which are typically 25 to 30% of the initial cost of the unit, and is also usually economically unattractive. The installation of a complementary compressor in parallel with an existing compressor has been most often practiced as the most economical and thus most attractive alternative. This invention provides a more attractive and advantageous alternative to the prior art methods mentioned.

Accordingly an object of this invention is to provide a method and apparatus for increasing the capacity of an existing compressor.

Features of this invention are that the apparatus involves little added mechanical complexity and lower capital cost than prior methods.

Advantages of this invention are a savings in operating power in the compressor operation and some capability of adjusting the compressor capacity without a performance penalty.

SUMMARY OF THE INVENTION

Apparatus embodying the method of this invention comprises a supercharger for receiving, compressing and discharging an airflow into an evaporative cooler. The cooler comprises a section of pipe for conveying the airflow from the supercharger to a main air compressor. Mounted on the wall of the pipe are nozzles oriented to spray water upstream into the airflow for evaporation and cooling effect. The nozzles have internal passages sized to atomize water into droplets preferably of mean diameter ranging from about 4 to about 12 microns. The pipe is sized to provide a residence time preferably of from about 0.1 to about 0.5 seconds for the droplets in the airflow. The nozzles are oriented to discharge upstream at an angle of not more than about 60° to the pipe wall. The system further comprises means for collecting the condensate from the intercoolers and aftercooler of the main compressor and returning the condensate to the nozzles for spraying into the airflow.

DESCRIPTION OF THE PREFERRED EMBODIMENT

Figure 1:
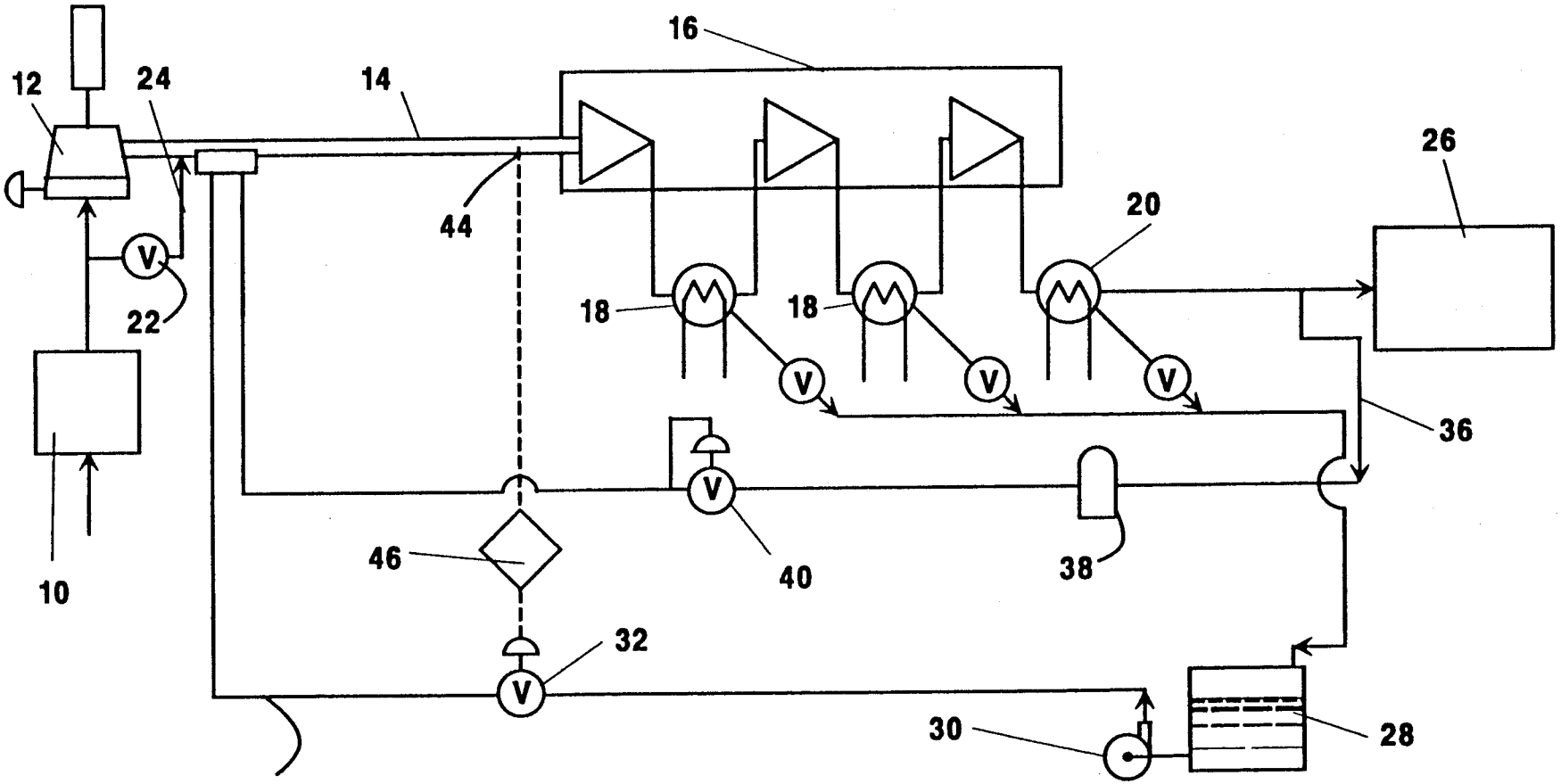
FIG. 1 is a flow schematic of the apparatus involved in this invention.

As shown in FIG. 1, atmospheric air is induced through a filter 10 by a supercharger 12 or blower which provides a stage of compression of small pressure ratio. Typically the air pressure is elevated in the supercharger by an increment of 5 to 100 inches of water with a resulting rise in temperature of the airflow of 10° to 30° F. A supercharger or blower of appropriate capacity may be selected from many positive displacement and centrifugal models available from various manufacturers. A centrifugal supercharger is preferred because it provides some variable capacity capability.

The supercharged air flows into an evaporative cooler 14 and then into a main air compressor 16 which has several compression stages with intercoolers 18 and an aftercooler 20. A bypass valve 22 in a bypass line 24 can be opened to allow atmospheric air to flow directly into the evaporative cooler 14 when the supercharger 12 is not operated. Compressed air flows from the main compressor aftercooler 20 to the process equipment 26.

Condensate is separated from the compressed airflow in the intercoolers and aftercoolers and collected in a condensate collection tank 28. A condensate pump 30 transfers the condensate via a line 31 through a flow control valve 32 to atomizing nozzles 34 in the evaporative cooler where the condensate is sprayed into the airflow. The spraying is accomplished with compressed air taken by a conduit 36 from the discharge of the main compressor aftercooler 20 through a filter 38 and through a control valve 40.

It is undesirable for unevaporated droplets of water to impinge upon the main compressor impeller because of erosion and vibratory fatigue problems. Therefore, sensors 44 monitor the temperature and humidity of the gas at the entrance of the main compressor. Their measurements are processed in an automated controller 46 which regulates the condensate flow control valve 32. The control system serves two purposes: to insure that liquid droplets are evaporated before they reach the main compressor; and to minimize the electrical Power used by the compressor while delivering the desired mass flow. Lower compressor inlet temperature produces higher mass flow and power draw. Thus the control system is able to control the mass flow and power draw over a small range.

Figure 2:
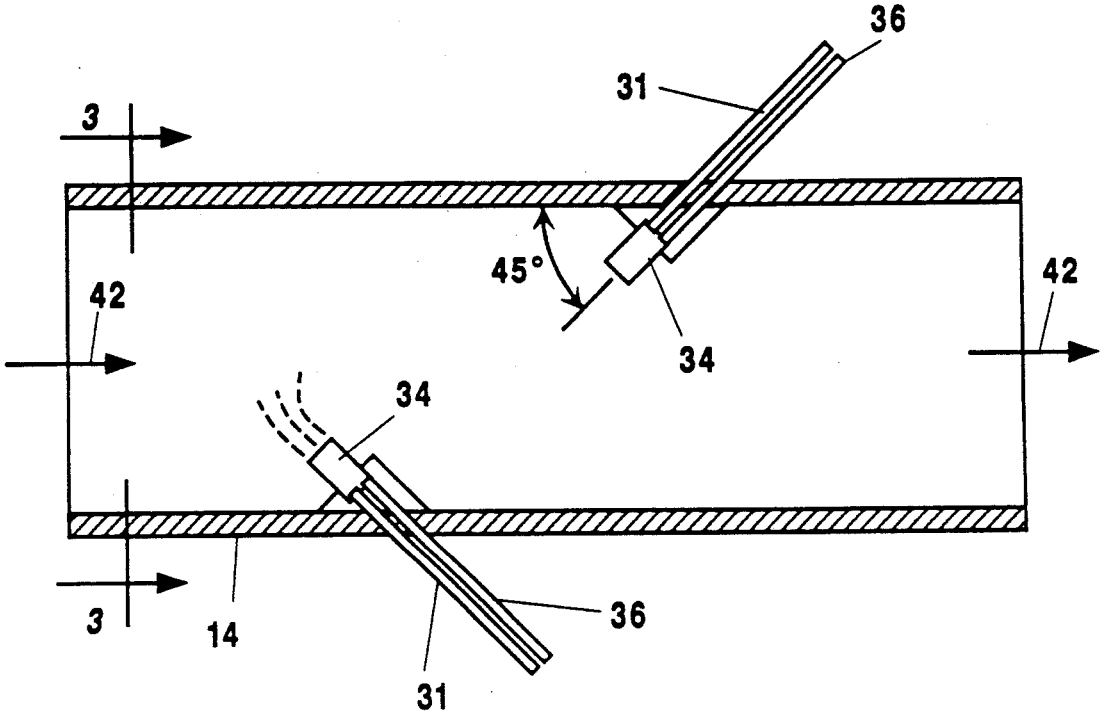
FIG. 2 is a longitudinal cross-section of the evaporative cooler following the supercharger.
Figure 3:
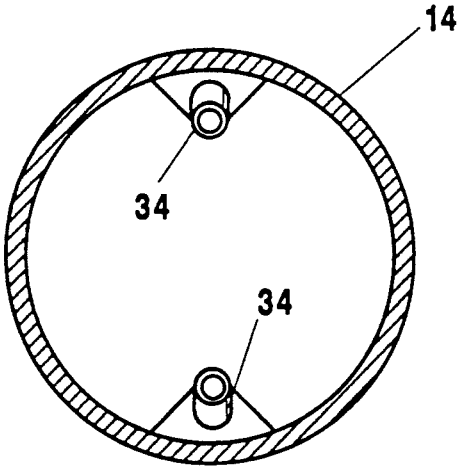
FIG. 3 is a section of the evaporative cooler of FIG. 2 taken along the line 3—3 in FIG. 2.

The evaporative cooler 14 preferably comprises a section of pipe connecting the discharge of the supercharger with the main air compressor inlet. The atomizing nozzles 34 within the pipe are oriented to discharge upstream at an angle of not more than 60° to the pipe wall. As shown in FIG. 2 and FIG. 3, the nozzles 34 are mounted on the wall at a preferred angle of about 45° to the wall. The nozzles are directed to spray upstream into the airflow 42 to induce turbulence and mixing which enhances evaporation of the spray. The nozzles have internal passages that are sized to atomize the supplied liquid with compressed air into droplets. The evaporative cooling of an airflow in a pipe with spray nozzles is a complex process. The evaporation rate varies appreciably with the water droplet size, the temperature and relative humidity of the airflow entering the cooler, and the physical arrangement of the nozzles and the pipe. The evaporation rate also varies slightly with the airflow velocity in the pipe. Thus the combination of droplet size range and droplet residence time in the evaporating pipe is important in obtaining satisfactory performance of the evaporative cooler.

With droplet sizes in the range of about 5 to about 20 microns, atomizing spray nozzles that use compressed air to atomize supplied liquid are usable. With droplet size below 5 microns, ultrasonic nozzles are necessary. To process sufficient liquid for this application, the number of such nozzles would be prohibitively large and costly. With droplet size above 20 microns, basic spray nozzles are usable. However, the evaporation time for these droplets is so long that the length and diameter of the evaporating pipe is prohibitively large and costly.

It has been discovered that droplet sizes in the range of about 4 to about 20 microns coupled with a residence time of from about 0.05 to about 1.0 seconds in the gas flow in the evaporator provide an operable situation. Droplets in the range of about 8 to about 12 microns in combination with a residence time from about 0.2 to about 0.4 seconds are preferred.

It has also been discovered that it is desirable to limit the air velocity in the cooler to less than 100 feet per second to avoid excessive pressure drop. Preferably the air velocity is in the range of from about 15 to about 50 feet per second.

While fresh water can be used in the evaporative cooler, the recycling of condensate is preferred. The condensate is clean and devoid of dissolved minerals. Thus treatment costs for fresh water and descaling operations in the cooler are avoided.

Other types of coolers to cool the air emerging the supercharger are usable, but are less desirable. Passing the supercharged air through a bed of packing wetted by water requires greater volume, mechanical complexity and initial investment than the cooler provided by this invention. Passing the supercharged air over coils or tubes cooled by a cooling medium also requires greater volume, complexity and initial investment. In addition, the vibration produced by the compressor can cause fatigue and breakdown of the packing, or any extended surface on the coils or tubes. The resulting particles can be carried into and cause damage to the compressor.

With the supercharger in service and the main air compressor delivering the same outlet pressure as before the installation of the supercharger, the main compressor operates at a lower pressure ratio and thereby inherently delivers a higher airflow rate. Also, with the supercharger and cooler in service, the main compressor intakes denser airflow. Thus the main compressor compresses a greater mass flow which provides a further capacity increase. Inherently, a slightly higher efficiency and reduced power requirement for compression per unit mass of airflow occurs.

The disclosed system allows from 60 to 100% adjustment in operating capacity. This compares favorably with the adjustment in flow capacity of up to 20% usually provided by a standard centrifugal compressor by adjustment of its inlet guide vanes.

The disclosed system also offers a modest but significant adjustment in capacity by operating the main compressor without operating the supercharger. The cooler can provide some decrease in the temperature of the airflow induced by the main compressor and thus a slight improvement in capacity. The temperature decrease which is available with or without the supercharger in operation is dependent on the relative humidity of the atmospheric air. This affects the amount of water which can be added by evaporation into the airflow.

While the invention has been illustratively described with respect to the compression of air and the evaporation of water for cooling, it is applicable to other gases and evaporatable liquids as well.

COMPARATIVE EXAMPLE

An installed four-stage, intercooled, centrifugal, main compressor while drawing 3100 kw has a maximum capacity of compressing 1,250,000 cfh of air at 45% relative humidity and 70° F. from 14.7 psia to 85 psia. Under these conditions, the unit power of the compressor is 2.43 kw/1000 cfh of air compressed. An increase in compressed air supply capacity of 20% to 1,520,000 cfh is desired.

Pursuant to this invention, a supercharger is installed having an adiabatic efficiency of 79% which compresses air from the aforementioned intake conditions to 16.7 psia and 125° F. Following the supercharger is an evaporative cooler which evaporates water into the supercharged air to a relative humidity of 75% and a temperature of 85° F., thus producing a net density increase of 14%. The main air compressor continues to operate to deliver air at 85 psia, and because of the supercharging operates at 13% lower pressure ratio, at which it inherently delivers 6% greater flow. Thus the air density increase of 14% and the increase in compressor flow of 6% combine to yield the desired compressed air flow increase of 20%. With the addition of the supercharger and the evaporative cooler, an efficiency improvement of 0.5% is obtained, which reduces the unit power to 2.468 kw/1000 cfh of air. Thus the power increase for the 20% added compressed air flow is 650 kw.

The compression system advantageously has some capability for operation at reduced flow capacity. This is achieved by adjusting the amount of evaporative cooling performed, or by ceasing operation of the supercharger.

The installed evaporative cooler comprises a section of pipe 40 inches in inside diameter, 15 feet long connecting the supercharger with the main compressor. Mounted on the pipe wall are ten nozzles oriented to discharge upstream at an angle of 45° to the pipe wall. The nozzles atomize water into droplets having a mean size of 10 microns. The nozzles spray 9.8 gallons per hour of water at 60 psig using 4.42 scfm of air at 55 psig The section of pipe provides the droplets a residence time of 0.33 seconds in the airflow in the pipe.

A condensate tank collects the condensate from the main compressor intercoolers and aftercooler and a pump transfers the condensate to the nozzles. Considering the reduced operating power requirement, the capacity adjustability and the required capital cost this method and apparatus are superior to alternatives to be described.

One alternative is to retrofit the existing compressor with new pinions and impellers of higher flow capability. However, the retrofitted compressor efficiency is unchanged and the unit power requirement is unchanged. Thus the added power consumption is 670 kw. The retrofitted compressor while operating at the specified delivery pressure has little capability for reduced flow capacity. It also has somewhat higher power consumption and higher capital cost compared to the installation made according to the invention.

Another alternative is to install in parallel with the existing main air compressor a complementary air compressor to deliver the desired increase in airflow. A complementary air compressor because of its smaller size would have lower efficiency than the main air compressor. Thus the increase in power required to deliver the added airflow would be 700 kw. While this alternative has the capability of operation at reduced capacity by ceasing operation of the complementary compressor, it has somewhat higher electrical power consumption and higher capital cost compared to the system provided by this invention.

Although the invention has been described with reference to specific embodiments as examples, it will be appreciated that it is intended to cover all modifications and equivalents within the scope of the appended claims.

What is claimed is:

1. A system for increasing the capacity of a gas compressor comprising:
(a) a supercharger for receiving, compressing and discharging a gas flow; and
(b) an evaporative cooler comprising a section of pipe connecting said supercharger with the compressor, said pipe having a nozzle for spraying and evaporating a liquid into the gas flow for cooling of the gas flow, said nozzle having internal passages sized to atomize a liquid into droplets of mean diameter from about 4 to about 20 microns, said evaporative cooler being capable of completely evaporating the liquid sprayed into the gas flow before reaching the compressor so as to increase the capacity of the compressor and minimize the electrical power used by the compressor while delivering the desired mass flow of gas.

2. The system as in claim 1 wherein said gas compressor has intercoolers and aftercoolers and said system further comprises means for collecting condensate from the intercoolers and aftercoolers and returning the condensate for spraying into the gas flow.

3. The system as in claim 2 wherein the gas is air and liquid for cooling of the air flow is water.

4. The system as in claim 1 wherein said pipe has a diameter and length to provide a residence time of from about 0.05 to about 1.0 seconds for the droplets in the gas flow.

5. The system as in claim 1 wherein said pipe has a nozzle with internal passages sized to atomize a liquid into droplets of mean diameter from about 8 to about 12 microns and said pipe has a diameter and length to provide a residence time of from about 0.2 to about 0.4 seconds for the droplets in the gas flow.

6. The system as in claim 1 wherein the gas has a flow velocity of not more than about 100 feet per second in said evaporative cooler.

7. The system as in claim 1 wherein the gas has a flow velocity of from about 15 to about 50 feet per second in said evaporative cooler.

8. The system as in claim 1 wherein said nozzle is oriented to discharge upstream at an angle of not more than about 60° to the pipe wall.

9. The system as in claim 1 wherein said nozzle is oriented to discharge upstream at an angle of about 45° to the pipe wall.

10. The system as in claim 1 wherein said pipe has a diameter and length to provide a residence time of from about 0.05 to about 1.0 seconds for the droplets in the gas flow, and wherein said nozzle is oriented to discharge upstream at an angle of not more than about 60° to the pipe wall.

11. The system as in claim 1 further comprising:
(c) a sensor for monitoring gas temperature at the entrance to the gas compressor;
(d) a sensor for monitoring gas humidity at the entrance to the gas compressor; and
(e) a controller for processing the monitored gas temperature and monitored gas humidity and for regulating the flow of liquid to said nozzle so that the liquid sprayed into the gas flow is completely evaporated before reaching the gas compressor, and the electrical power used by the gas compressor is minimized.

12. A method for increasing the gas flow capacity of a gas compressor, said method comprising:
(a) supercharging the gas flow;
(b) providing a liquid capable of evaporation into and cooling the gas flow;
(c) atomizing the liquid into droplets having a mean diameter of from about 4 to about 20 microns;
(d) introducing the liquid droplets into the gas flow; and
(e) evaporating completely the liquid droplets sprayed into the gas flow before reaching the compressor so as to increase the capacity of the compressor and minimize the electrical power used by the compressor while delivering the desired mass flow of gas.

13. The method as in claim 12 further comprising:
(e) collecting condensate from the gas compressor intercoolers and aftercoolers; and
(j) returning the condensate for atomization into the supercharged gas flow.

14. The method as in claim 13 wherein the gas is air and the liquid is water.

15. The method as in claim 11 further comprising:
(e) monitoring the gas temperature at the entrance to the gas compressor;
(f) monitoring the gas humidity at the entrance to the gas compressor; and
(g) processing the monitored gas temperature and monitored gas humidity and regulating the flow of liquid to said nozzle so that the liquid sprayed into the gas flow is completely evaporated before reaching the gas compressor, and the electrical power used by the gas compressor is minimized.

16. The method as in claim 11 further comprising:
(f) directing the droplets upstream into the gas flow at an angle of not more than 60° to the gas flow direction; and
(g) providing a residence time of from about 0.05 to about 1.0 seconds for the droplets in the gas flow before entering the compressor.

* * * * *